US009058781B2

(12) United States Patent
Lin et al.

(10) Patent No.: US 9,058,781 B2
(45) Date of Patent: Jun. 16, 2015

(54) BACKLIGHT UNIT WITH CHANGING OSCILLATION FREQUENCY IN STEREOSCOPIC MODE AND LIQUID CRYSTAL DISPLAY USING THE SAME

(75) Inventors: Poshen Lin, Guangdong (CN); Liangchan Liao, Guangdong (CN); Xiang Yang, Guangdong (CN)

(73) Assignee: SHENZHEN CHINA STAR OPTOELECTRONICS TECHNOLOGY CO., LTD., Shenzhen, Guangdong (CN)

( * ) Notice: Subject to any disclaimer, the term of this patent is extended or adjusted under 35 U.S.C. 154(b) by 335 days.

(21) Appl. No.: 13/813,075

(22) PCT Filed: Jun. 28, 2012

(86) PCT No.: PCT/CN2012/077686

§ 371 (c)(1),
(2), (4) Date: Jan. 29, 2013

(87) PCT Pub. No.: WO2013/166768

PCT Pub. Date: Nov. 14, 2013

(65) Prior Publication Data

US 2013/0300642 A1 Nov. 14, 2013

(30) Foreign Application Priority Data

May 9, 2012 (CN) ..... 2012 1 0141505

(51) Int. Cl.

| | |
|---|---|
| ***G09G 3/36*** | (2006.01) |
| ***G09G 3/34*** | (2006.01) |
| *G09G 3/00* | (2006.01) |

(52) U.S. Cl.

CPC ..... *G09G 3/36* (2013.01); *G09G 3/003* (2013.01); *G09G 3/3406* (2013.01); *G09G 3/3611* (2013.01); *G09G 2330/021* (2013.01)

(58) Field of Classification Search

CPC ..... G09G 3/3406; G09G 3/3413; G09G 3/36
USPC ..... 345/102
See application file for complete search history.

(56) References Cited

U.S. PATENT DOCUMENTS

| | | | | |
|---|---|---|---|---|
| 6,812,921 | B2 | 11/2004 | Hsu | |
| 2007/0108918 | A1 * | 5/2007 | Sengoku et al. | 315/282 |

FOREIGN PATENT DOCUMENTS

| | | | |
|---|---|---|---|
| CN | 101206844 | A | 6/2008 |
| CN | 101727831 | A | 6/2010 |
| CN | 101944331 | A | 1/2011 |
| CN | 102237044 | A | 11/2011 |
| TW | 201115228 | A1 | 5/2011 |

* cited by examiner

*Primary Examiner* — Amare Mengistu
*Assistant Examiner* — Shawna Stepp Jones
(74) *Attorney, Agent, or Firm* — Muncy, Geissler, Olds & Lowe P.C.

(57) ABSTRACT

A liquid crystal display for displaying either a flat image or a stereoscopic image, comprising: a panel; and a backlight unit for providing a light source to the panel. The backlight unit comprising: a switch circuit and an oscillator. One end of the switch circuit is electrically connected with a first resistor, and another end of the switch circuit is electrically connected with a second resistor. When the switch circuit is turned on, the first resistor is connected with the second resistor in parallel. The oscillator is electrically connected with the first resistor and the switch circuit. When the switch circuit is turned off, the oscillator outputs a first frequency, and when the switch circuit is turned on, the oscillator outputs a second frequency.

11 Claims, 6 Drawing Sheets

BACKLIGHT UNIT WITH CHANGING OSCILLATION FREQUENCY IN STEREOSCOPIC MODE AND LIQUID CRYSTAL DISPLAY USING THE SAME

FIELD OF THE INVENTION

The present invention relates to a liquid crystal display, and more particularly to a backlight unit of the liquid crystal display having different oscillation frequencies for displaying either a flat image or a stereoscopic image.

BACKGROUND OF THE INVENTION

With the improvement and development of the technology, people have increased the enjoyment of material life and spiritual level, and never decreased, such that people hope to realize imagination and effect in immersive virtual reality via display devices. Therefor, how to display stereoscopic images or pictures in display devices is a target to be achieved by current technology.

FIG. 1 illustrates a timing chart of a power consumption of a backlight unit and an oscillator when a liquid crystal display displays a flat image according to prior art. When the oscillator is a high level signal, the backlight unit is a high level signal, too. That is, the backlight unit provides a light source to a panel, and the power consumption of the backlight unit is referred to as W1.

FIG. 2 illustrates a timing chart of a power consumption of a backlight unit and an oscillator when the liquid crystal display displays a stereoscopic image according to prior art. The frequency of oscillator during displaying the stereoscopic image is the same as the frequency of oscillator during displaying the flat image as shown in the FIG. 1. An image must display sequentially a right-eye picture and a left-eye picture when the liquid crystal display displays the stereoscopic image, such that it reduces a light emitting frequency of the backlight unit. In order to keep brightness of pictures, the backlight unit increases power of light sources. Therefore, the backlight unit provides a light source for the liquid crystal display during a high level signal, and a power consumption of the backlight unit is referred to as W2. It assumes that power consumption is in proportion to brightness of the light source, the power consumption of the backlight unit W2 during displaying the stereoscopic image is two times the power consumption of the backlight unit W1 during displaying the flat image.

For instance, when the liquid crystal display displays the flat image and the backlight unit provides a light source to a panel, the current to turn on the light source by the backlight unit is 120 mA. However, when the liquid crystal display displays the stereoscopic image and the backlight unit provides a light source to a panel, the current to turn on the light source by the backlight unit is 240 mA. The output current during displaying the stereoscopic image is two times the outputting current during displaying the flat image. That is, the output power is two times the original output power. In the other words, in the other conditions remain unchanged, the load current of original magnetic material is 120 mA, but the load current of magnetic material becomes 240 mA during displaying the stereoscopic image, such that it needs to choose magnetic materials of which the withstand current is 240 mA, which led to cost increasing and material waste.

Thus, a liquid crystal display is required to reduce the power consumption of a backlight unit when the backlight unit is turned on during displaying a stereoscopic image.

SUMMARY

In order to solve the problems mentioned above, an objective of the present invention provides a liquid crystal display for displaying either a flat image or a stereoscopic image. The liquid crystal display comprises a panel and a backlight unit. The backlight unit provides a light source to the panel, wherein the backlight unit comprises a switch circuit, an oscillator, a control unit, a first resistor and a second resistor. One end of the switch circuit is connected with the first resistor, and another end of the switch circuit is connected with the second resistor. When the switch circuit is turned on, the first resistor is connected with the second resistor in parallel. The oscillator comprises a frequency output terminal, and the oscillator outputs different frequencies according to an equivalent resistance measured at the frequency output terminal. In addition, if the measured equivalent resistance is smaller at the frequency output terminal, the output frequency of the oscillator is higher. Alternately, if the measured equivalent resistance is higher at the frequency output terminal, the output frequency of the oscillator is smaller. The frequency output terminal is electrically connected with the first resistor and the switch circuit. When the switch circuit is turned off, the measured equivalent resistance at the frequency output terminal of the oscillator is a value of the first resistor, and the oscillator outputs a first frequency. When the switch circuit is turned on, the measured equivalent resistance is a value of the first resistor connected with the second resistor in parallel, and the oscillator outputs a second frequency. The control unit is electrically connected with the switch circuit and outputs a control signal to control the switch circuit whether to turn on or off. In addition, if a value of the first resistor is the same as that of second resistor, it is indicated that the second frequency outputted by the oscillator when the switch circuit is turned on is higher than the first frequency outputted by the oscillator when the switch circuit is turned off, and the second frequency is two times the first frequency. Moreover, when the liquid crystal display displays a flat image, the oscillator outputs the first frequency, and when the liquid crystal display displays a stereoscopic image, the oscillator outputs the second frequency.

The present invention has an advantageous effect in that the power consumption of the backlight unit maintains a stable state by the first frequency and the second frequency. Therefore, a cheaper material can be adopted in the present invention, so that the manufacturing cost for liquid crystal displays can be reduced.

DETAILED DESCRIPTION OF THE EMBODIMENTS

Now, the preferred embodiment of the present invention will be described in detail with reference to the accompanying drawings.

Figure 1:
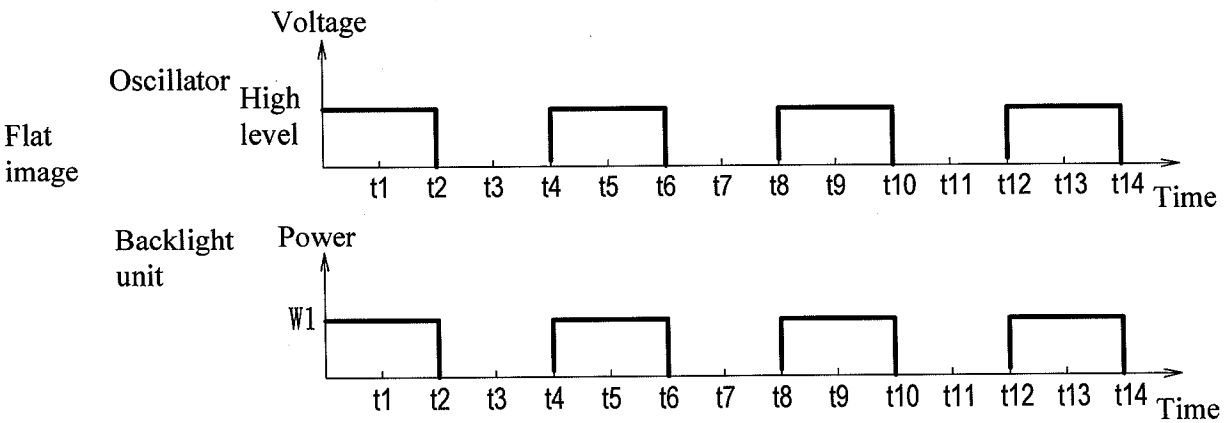
FIG. 1 (prior art)
FIG. 1 illustrates a timing chart of the power consumption of a backlight unit and an oscillator when a liquid crystal display displays a flat image according to prior art.
Figure 2:
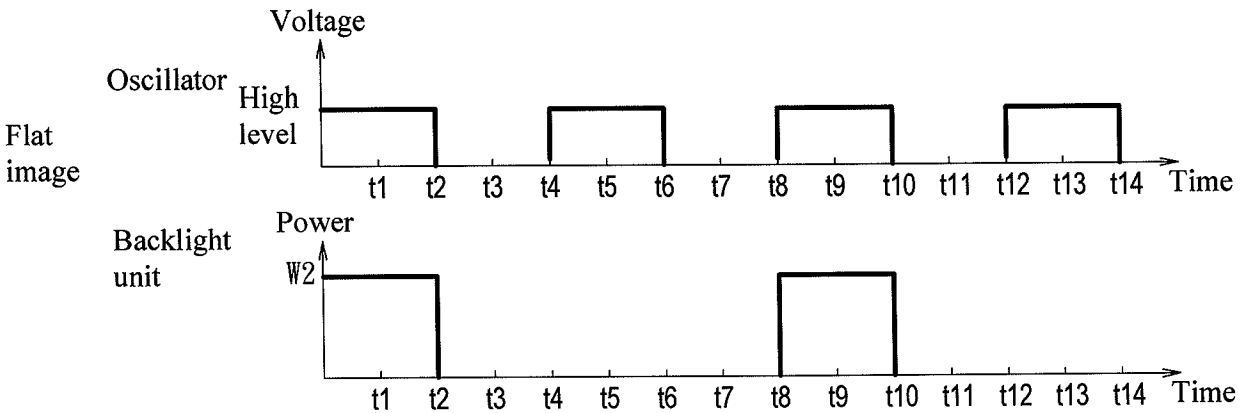
FIG. 2 (prior art)
FIG. 2 illustrates a timing chart of the power consumption of a backlight unit and an oscillator when the liquid crystal display displays a stereoscopic image according to prior art.
Figure 3:
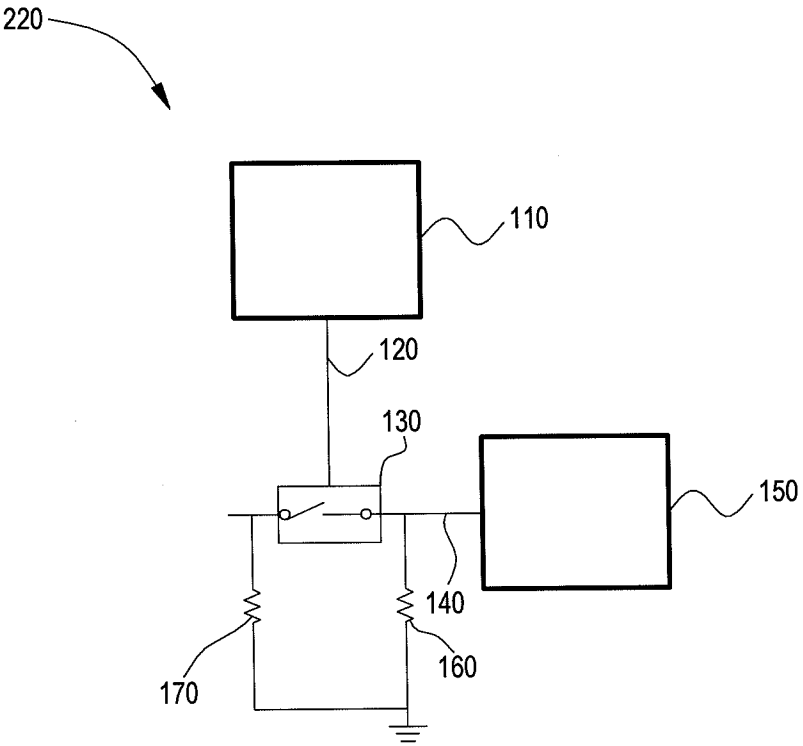
FIG. 3 is a schematic illustration of a circuit of a backlight unit according to the preferred embodiment of the present invention.
Figure 6:
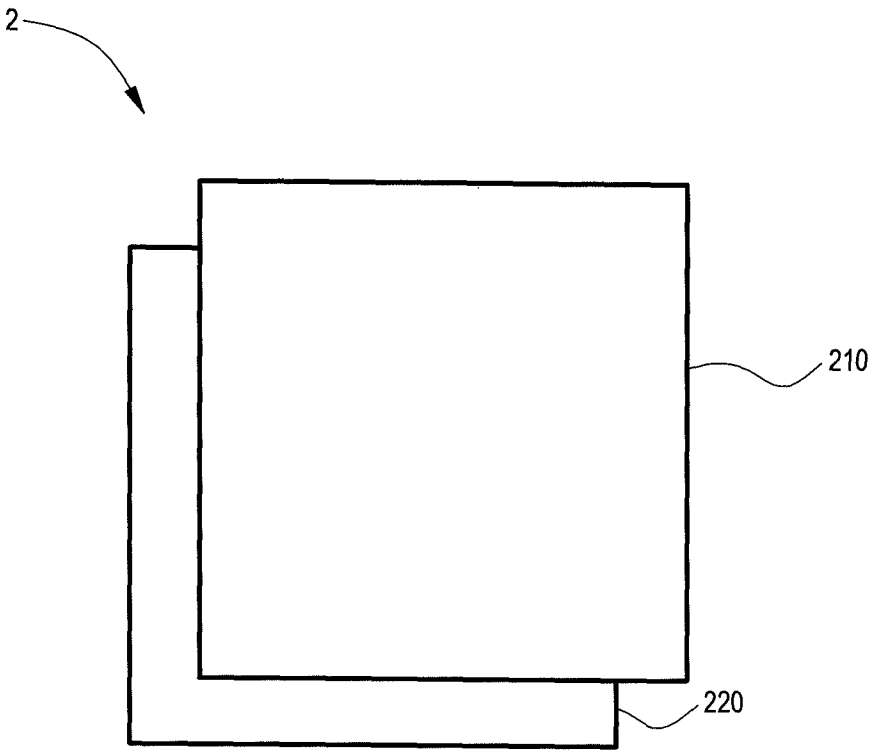
FIG. 6 is an illustration of a liquid crystal display according to the preferred embodiment of the present invention.

Referring to FIG. 6, it is an illustration of a liquid crystal display according to the preferred embodiment of the present invention. Please refer to FIG. 3 together, FIG. 3 is a schematic illustration of a circuit of a backlight unit according to the preferred embodiment of the present invention. The liquid crystal display (LCD) 2 displays either a flat image or a stereoscopic image, and the LCD 2 comprises a panel 210 and a backlight unit 220. The backlight unit provides a light source to the panel 210, wherein the backlight unit 220 comprises a switch circuit 130, an oscillator 150, a control unit 110, a first resistor 160 and a second resistor 170. One end of the switch circuit 130 is electrically connected with the first resistor 160, and another end thereof is connected with the second resistor 170. When the switch circuit 130 is turned on, the first resistor 160 is connected with the second resistor 170 in parallel. The oscillator 150 includes a frequency output terminal 140, and the oscillator outputs different frequencies according an equivalent resistance measured at the frequency output terminal. In addition, if the measured equivalent resistance is smaller at the frequency output terminal 140, the output frequency of the oscillator 150 is higher. Alternately, if the measured equivalent resistance is higher at the frequency output terminal 140, the output frequency of the oscillator 150 is smaller. The frequency output terminal 140 is connected with the first resistor 160 and the switch circuit 130. When the switch circuit 130 is turned off, the measured equivalent resistance at the frequency output terminal 140 of the oscillator 150 is a value of the first resistor 160, and the oscillator 150 outputs a first frequency. When the switch circuit 130 is turned on, the measured equivalent resistance is a value of the first resistor 160 connected with the second resistor 170 in parallel, and the oscillator outputs 150 a second frequency. The control unit 110 is electrically connected with the switch circuit 130 and outputs a control signal 120 to control the switch circuit 130 whether to turn on or off In addition, if a value of the first resistor 160 is the same as that of second resistor 170, it is indicated that the second frequency outputted by the oscillator 150 when the switch circuit 130 is turned on is higher than the first frequency outputted by the oscillator 150 when the switch circuit is turned off, and the second frequency is two times the first frequency. Moreover, when the liquid crystal display 2 displays a flat image, the oscillator 150 outputs the first frequency, and when the liquid crystal display 2 displays a stereoscopic image, the oscillator 150 outputs the second frequency.

Figure 4:
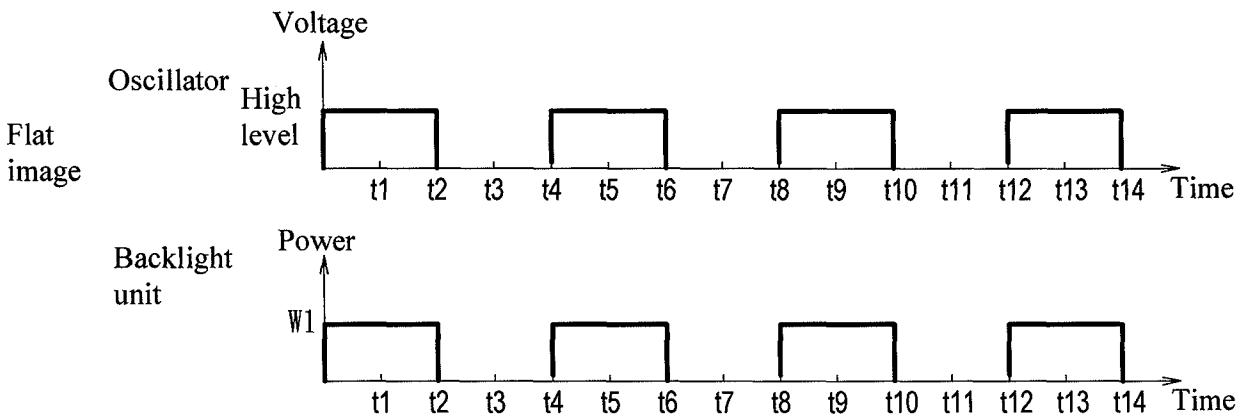
FIG. 4 illustrates a timing chart of the oscillator output frequency and the power consumption of a backlight unit when the liquid crystal display displays a flat image according to the present invention.

Referring FIG. 4, it illustrates a timing chart of the oscillator output frequency and the power consumption of a backlight unit when the liquid crystal display displays a flat image according to the present invention, and please refer to FIG. 3 and FIG. 6 together. When the liquid crystal display 2 displays a flat image, the control unit 110 outputs a control signal 120 to control the switch circuit 130 being an off state, wherein the measured equivalent resistance at the frequency output terminal 140 of the oscillator 150 is a value of the first resistor 160, and the oscillator 150 then outputs a first frequency. The power consumption frequency of the backlight unit 220 is the first frequency, and the power consumption of the backlight unit 220 is referred to as W1.

Figure 5:
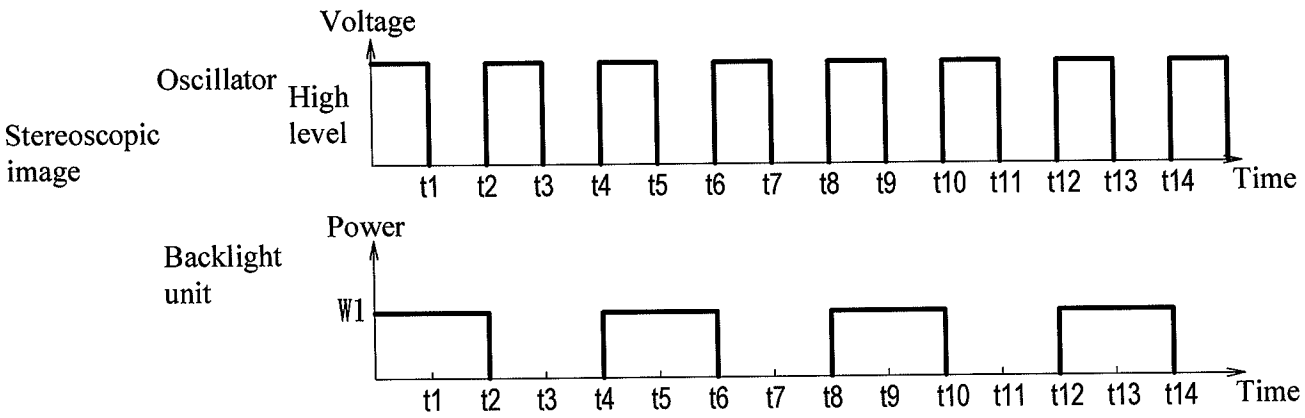
FIG. 5 illustrates a timing chart of the oscillator output frequency and the power consumption of a backlight unit when the liquid crystal display displays a stereoscopic image according to the present invention.

Referring to FIG. 5, it illustrates a timing chart of the oscillator output frequency and the power consumption of a backlight unit when the liquid crystal display displays a stereoscopic image according to the present invention, and please refer to FIG. 3 and FIG. 6 together. When the liquid crystal display 2 displays a stereoscopic image, the control unit 110 outputs a control signal 120 to control the switch circuit 130 being an on state, wherein the measured equivalent resistance is a value of the first resistor 160 connected with the second resistor 170 in parallel at the frequency output terminal 140 of the oscillator 150, and the oscillator 150 then outputs a second frequency. When the LCD displays the stereoscopic image, an image must be sequentially show right-eye picture and left-eye picture, which reduces the power consumption frequency of the backlight unit 220. Therefore, the power consumption frequency of the backlight unit 220 is the first frequency, and the power consumption of the backlight unit 220 is referred to as W1.

As the foregoing, the liquid crystal display provided by the present invention has an advantageous effect in that the power consumption of the backlight unit maintains as w1 by the first frequency and the second frequency. The backlight unit of the present invention may choose cheaper magnetic materials, so that the manufacturing cost for liquid crystal displays can be reduced.

The previous description of the preferred embodiment is provided to further describe the present invention, not intended to limit the present invention. Any modification apparent to those skilled in the art according to the disclosure within the scope will be construed as being included in the present invention.

What is claimed is:

1. A liquid crystal display for displaying either a flat image or a stereoscopic image, comprising:

a panel; and a backlight unit for providing a light source to the panel, the backlight unit comprising:

a switch circuit, one end of the switch circuit being electrically connected with a first resistor, another end of the switch circuit being electrically connected with a second resistor, when the switch circuit is turned on, the first resistor is connected with the second resistor in parallel;

an oscillator being electrically connected with the first resistor and the switch circuit, when the switch circuit is turned off, the oscillator outputs a first frequency; when the switch circuit is turned on, the oscillator outputs a second frequency; and a control unit being electrically connected with the switch circuit to control the switch circuit whether to turn on or off;

wherein the oscillator outputs the first frequency when the liquid crystal display displays the flat image, and the oscillator outputs the second frequency when the liquid crystal display displays the stereoscopic image, the control unit controls the switch circuit to turn off when the liquid crystal display displays the flat image, and turn on when the liquid crystal display displays the stereoscopic image, the oscillator outputs the first frequency when the liquid crystal display displays the flat image and the oscillator outputs the second frequency when the liquid crystal display displays the stereoscopic image, and the second frequency is two times the first frequency.

2. A liquid crystal display for displaying either a flat image or a stereoscopic image, comprising:

a panel; and a backlight unit for providing a light source to the panel, the backlight unit comprising:

a switch circuit, one end of the switch circuit being electrically connected with a first resistor, another end of the switch circuit being electrically connected with a second resistor, when the switch circuit is turned on, the first resistor is connected with the second resistor in parallel; and an oscillator being electrically connected with the first resistor and the switch circuit, when the switch circuit is turned off, the oscillator outputs a first frequency; when the switch circuit is turned on, the oscillator outputs a second frequency, wherein the oscillator outputs the first frequency when the liquid crystal display displays the flat image; and the oscillator outputs the second frequency when the liquid crystal display displays the stereoscopic image.

3. The liquid crystal display of claim 2, wherein the second frequency is higher than the first frequency.

4. The liquid crystal display of claim 3, wherein the backlight unit further comprises a control unit, the control unit being electrically connected with the switch circuit to control the switch circuit whether to turn on or off.

5. The liquid crystal display of claim 4, wherein the control unit controls the switch circuit to turn off when the liquid crystal display displays the flat image, and turn on when the liquid crystal display displays the stereoscopic image.

6. The liquid crystal display of claim 5, wherein the oscillator outputs the first frequency when the liquid crystal display displays the flat image and the oscillator outputs the second frequency when the liquid crystal display displays the stereoscopic image.

7. The liquid crystal display of claim 2, wherein the second frequency is two times the first frequency.

8. A backlight unit for providing a light source to a panel, comprising:

a switch circuit, one end of the switch circuit being electrically connected with a first resistor, another end of the switch circuit being electrically connected with a second resistor, when the switch circuit is turned on, the first resistor is connected with the second resistor in parallel; and an oscillator being electrically connected with the first resistor and the switch circuit, when the switch circuit is turned off, the oscillator outputs a first frequency; when the switch circuit is turned on, the oscillator outputs a second frequency.

9. The backlight unit of claim 8, wherein the second frequency is higher than the first frequency.

10. The backlight unit of claim 8, wherein the backlight unit further comprises a control unit, the control unit is electrically connected with the switch circuit to control the switch circuit whether to turn on or off.

11. The backlight unit of claim 8, wherein the second frequency is two times the first frequency.

* * * * *